US010689929B2

(12) United States Patent
Fraczek et al.

(10) Patent No.: US 10,689,929 B2
(45) **Date of Patent: *Jun. 23, 2020**

(54) MPD-CAPABLE FLOW SPOOLS

(71) Applicant: Ameriforge Group Inc., Houston, TX (US)

(72) Inventors: Justin Fraczek, Houston, TX (US); Roland Kennedy, Houston, TX (US); Randy Arthion, Houston, TX (US); Alex Gidman, Houston, TX (US)

(73) Assignee: AMERIFORGE GROUP, INC., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/910,902

(22) Filed: Mar. 2, 2018

(65) Prior Publication Data

US 2018/0320466 A1 Nov. 8, 2018

Related U.S. Application Data

(63) Continuation of application No. 14/888,884, filed as application No. PCT/US2014/036309 on May 1, 2014, now Pat. No. 9,970,247.

(Continued)

(51) Int. Cl.
*E21B 17/01* (2006.01)
*E21B 19/00* (2006.01)

(Continued)

(52) U.S. Cl.
CPC ..... *E21B 21/10* (2013.01); *E21B 17/01* (2013.01); *E21B 19/002* (2013.01);

(Continued)

(58) Field of Classification Search
CPC ..... E21B 17/01; E21B 17/085; E21B 19/002; E21B 19/004; E21B 21/001; E21B 21/08; E21B 21/10; E21B 33/076
See application file for complete search history.

(56) References Cited

U.S. PATENT DOCUMENTS 4,183,562 A * 1/1980 Watkins ..... E21B 17/085 285/23
4,210,208 A * 7/1980 Shanks ..... E21B 17/01 166/352

(Continued)

FOREIGN PATENT DOCUMENTS

WO WO 86/02696 5/1986
WO WO 2013/024354 2/2013

(Continued)

OTHER PUBLICATIONS

Frink, "Managed pressure drilling—what's in a name?" *Drilling Contractor*, Mar./Apr. 2006, pp. 36-39.

(Continued)

*Primary Examiner* — Matthew R Buck
(74) *Attorney, Agent, or Firm* — Norton Rose Fulbright US LLP

(57) ABSTRACT

This disclosure includes flow spool riser segment assemblies that are suitable for managed pressure drilling (MPD) and that can be lowered (e.g., when connected to other riser segment assemblies) through a rotary of a drilling rig. Some embodiments are configured to have portions of the flow spool connected (e.g., without welding) below the rotary.

38 Claims, 16 Drawing Sheets

Related U.S. Application Data

(60) Provisional application No. 61/819,108, filed on May 3, 2013.

(51) Int. Cl.

| | |
|---|---|
| ***E21B 21/00*** | (2006.01) |
| ***E21B 21/08*** | (2006.01) |
| ***E21B 21/10*** | (2006.01) |
| ***E21B 33/076*** | (2006.01) |
| ***E21B 33/064*** | (2006.01) |
| ***E21B 33/08*** | (2006.01) |

(52) U.S. Cl.
CPC ..... *E21B 21/001* (2013.01); *E21B 21/08* (2013.01); *E21B 33/064* (2013.01); *E21B 33/076* (2013.01); *E21B 33/085* (2013.01)

(56) References Cited

U.S. PATENT DOCUMENTS

| | | | | |
|---|---|---|---|---|
| 4,444,401 | A | 4/1984 | Roche et al. | |
| 4,987,956 | A * | 1/1991 | Hansen | E21B 29/08 166/340 |
| 7,237,623 | B2 | 7/2007 | Hannegan | 175/7 |
| 7,347,455 | B1 | 3/2008 | Taquino | |
| 8,127,854 | B2 | 3/2012 | Haheim | 166/367 |
| 8,317,234 | B2 * | 11/2012 | McKay | E21B 33/038 285/81 |
| 8,413,724 | B2 * | 4/2013 | Carbaugh | E21B 17/085 166/344 |
| 8,528,647 | B2 * | 9/2013 | Guesnon | E21B 17/085 166/338 |
| 8,783,359 | B2 * | 7/2014 | Reed | E21B 21/06 166/267 |
| 8,863,845 | B2 * | 10/2014 | Gilmore | E21B 17/01 166/338 |
| 8,960,302 | B2 * | 2/2015 | Shilling | E21B 17/015 166/345 |
| 9,074,425 | B2 * | 7/2015 | Feasey | E21B 21/08 |
| 9,109,420 | B2 * | 8/2015 | Tindle | E21B 33/035 |
| 9,121,227 | B2 | 9/2015 | Thommesen | |
| 9,428,975 | B2 * | 8/2016 | Stave | E21B 17/01 |
| 9,765,587 | B2 | 9/2017 | Boulanger et al. | |
| 9,803,443 | B2 | 10/2017 | Tindle et al. | |
| 9,909,379 | B2 | 3/2018 | Fraczek et al. | |
| 9,970,247 | B2 * | 5/2018 | Fraczek | E21B 17/01 |
| 10,012,031 | B2 | 7/2018 | Fraczek et al. | |
| 10,012,044 | B2 | 7/2018 | Leba et al. | |
| 2002/0014340 | A1 | 2/2002 | Johnson | |
| 2008/0264644 | A1 | 10/2008 | Sawtell | |
| 2009/0260831 | A1 | 10/2009 | Moksvold | 166/350 |
| 2010/0300699 | A1 * | 12/2010 | Papon | E21B 17/01 166/367 |
| 2011/0017466 | A1 * | 1/2011 | Averbuch | E21B 17/085 166/345 |
| 2011/0073315 | A1 | 3/2011 | Guesnon et al. | |
| 2011/0209876 | A1 | 9/2011 | Reed et al. | |
| 2011/0225789 | A1 | 9/2011 | Darnell | 29/428 |
| 2011/0253445 | A1 | 10/2011 | Hannegan et al. | 175/5 |
| 2012/0037377 | A1 * | 2/2012 | Walker | E21B 17/01 166/345 |
| 2012/0055677 | A1 | 3/2012 | Boyd | 166/350 |
| 2012/0132432 | A1 | 5/2012 | Carbaugh et al. | |
| 2012/0312544 | A1 * | 12/2012 | Tavner | E21B 17/085 166/367 |
| 2013/0043036 | A1 | 2/2013 | Kotrla et al. | 166/345 |
| 2013/0161021 | A1 | 6/2013 | Makosey et al. | |
| 2014/0193282 | A1 * | 7/2014 | Stave | E21B 17/01 417/572 |
| 2014/0209316 | A1 | 7/2014 | Tindle et al. | |
| 2014/0262313 | A1 * | 9/2014 | Gilmore | E21B 33/085 166/363 |
| 2015/0096759 | A1 | 4/2015 | Gilmore | |
| 2016/0032662 | A1 | 2/2016 | Walker et al. | |
| 2016/0076312 | A1 | 3/2016 | Fraczek et al. | |
| 2016/0138352 | A1 | 5/2016 | Leba et al. | |
| 2017/0067295 | A1 | 3/2017 | Gilmore et al. | |
| 2018/0245416 | A1 | 8/2018 | Fraczek et al. | |

FOREIGN PATENT DOCUMENTS

| | | | |
|---|---|---|---|
| WO | WO-2013024354 A2 * | 2/2013 | E21B 17/01 |
| WO | WO 2014/151724 | 9/2014 | |
| WO | WO 2014/179532 | 11/2014 | |
| WO | WO 2014/179538 | 11/2014 | |

OTHER PUBLICATIONS

International Search Report and Written Opinion issued in PCT/US2014/036309, dated Sep. 4, 2014.

Extended European Search Report issued in Application No. 14791083, dated Jan. 5, 2017.

International Search Report and Written Opinion issued in International Patent Application No. PCT/US2018/026513, dated Jun. 28, 2018.

International Search Report and Written Opinion issued in International Patent Application No. PCT/US2018/026518, dated Jul. 2, 2018.

International Preliminary Report on Patentability Issued in Corresponding PCT Application No. PCT/US2018/026513, dated Oct. 8, 2019.

International Preliminary Report on Patentability Issued in Corresponding PCT Application No. PCT/US2018/026518, dated Oct. 8, 2019.

* cited by examiner

MPD-CAPABLE FLOW SPOOLS

PRIORITY CLAIM

This application is a continuation of U.S. patent application Ser. No. 14/888,884, filed Nov. 3, 2015, (issued as U.S. Pat. No. 9,970,247 on May 15, 2018), which is a national phase application under 35 U.S.C. § 371 of International Application No. PCT/US2014/36309, filed May 1, 2014, which claims the benefit of U.S. Provisional patent application Ser. No. 61/819,108, filed May 3, 2013, each of which is incorporated herein by reference in its entirety.

FIELD OF THE INVENTION

The invention relates generally to riser assemblies for use in drilling operations and, more particularly, but not by way of limitation, to riser assemblies that can be lowered through a rotary of an offshore platform for assembly of auxiliary components below the rotary.

BACKGROUND

Offshore drilling operations have been undertaken for many years. Traditionally, pressure within a drill string and riser pipe have been governed by the density of drilling mud alone. More recently, attempts have been made to control the pressure within a drill string and riser pipe using methods and characteristics to the density of drilling mud. Such attempts may be referred to in the art as managed pressure drilling (MPD). See, e.g., Frink, *Managed pressure drilling—what's in a name*?, Drilling Contractor, March/April 2006, pp. 36-39.

SUMMARY

MPD techniques generally require additional or different riser components relative to risers used in conventional drilling techniques. These new or different components may be larger than those used in conventional techniques. For example, riser segments used for MPD techniques may utilize large components that force auxiliary lines to be routed around those components, which can increase the overall diameter or transverse dimensions of riser segments relative to riser segments used in conventional drilling techniques. However, numerous drilling rigs are already in existence, and it is generally not economical to retrofit those existing drilling rigs to fit larger riser segments.

Currently, MPD riser segment assemblies and/or components with an overall diameter or other transverse dimension that is too large to fit through a rotary or rotary table of a drilling rig must be loaded onto the rig below the deck (e.g., on the mezzanine level) and moved laterally into position to be coupled to the riser stack below the rotary. This movement of oversize components is often more difficult than vertically lowering equipment through the rotary from above (e.g., with a crane). At least some of the present embodiments can address this issue for MPD-capable flow spool components by allowing a flow spool riser segment to be lowered through a rotary and having portions of the flow spool connected (e.g., without welding) below the rotary (e.g., portions that would prevent the flow spool segment from passing through the rotary if those portions were connected before the flow spool is passed through the rotary).

Some embodiments of the present riser segment assemblies comprise: a main tube defining a primary lumen; a collar defining a lateral opening in fluid communication with the primary lumen; and a valve coupled to the lateral opening, the valve having a longitudinal flow axis that is more parallel than perpendicular to a longitudinal axis of the main tube. Some embodiments further comprise: two flanges each coupled to a different end of the main tube, each flange comprising: a mating face configured to mate with a flange of an adjacent riser segment; and a central flange lumen configured to be in fluid communication with the primary lumen of the main tube. In some embodiments, the collar is unitary with one of the two flanges. In some embodiments, the lateral opening is not threaded. In some embodiments, the valve comprises a double ball valve.

Some embodiments of the present riser segment assemblies further comprise: a fitting coupled to the collar over the lateral opening and to the valve, the fitting defining a fitting lumen in fluid communication with the lateral opening. In some embodiments, a portion of the fitting that is closer to the valve than to the collar has a longitudinal axis that is substantially parallel to a longitudinal axis of the main tube. Some embodiments further comprise: a first connector secured to the fitting and to a first end of the valve, a second connector secured to a second end of the valve and having a protrusion, and a third connector configured to be coupled to the main tube and defining a recess configured to slidably receive the protrusion of the second connector to provide a sealed connection between the second connector and the third connector. In some embodiments, the third connector defines a lumen having an inlet through which fluid can enter the third connector in a first direction, and an outlet through which fluid can exit the third connector in a second direction that is different than the first direction. In some embodiments, the second direction is substantially opposite the first direction. In some embodiments, the third connector further defines a secondary lumen with a second exit sealed by a removable cover, the second exit configured such that if the cover is removed, fluid can exit the third connector in a third direction that is different than the first direction and the second direction. Some embodiments further comprise: a retainer coupled to the main tube and configured releasably engage the third connector without welding to secure the third connector in fixed relation to the main tube. In some embodiments, the retainer includes a body having a recess configured to receive a portion of the third connector to restrict lateral movement of the third connector relative to the main tube. In some embodiments, the retainer includes one or more movable members pivotally coupled to the body and movable between an open position in which the third connector is permitted to enter or exit the recess of the body, and a closed position in which the one or more movable members prevent the third connector from entering or exiting the recess of the body.

In some embodiments of the present riser segment assemblies, the maximum transverse dimension of the assembly is less than 60.5 inches. In some embodiments, the maximum transverse dimension of the assembly is greater than 60.5 inches if the second connector is coupled to main tube, and is less than 60.5 inches if the second connector is not coupled to the fitting. In some embodiments, the fitting and the collar are configured to form a substantially gapless connection comprising: a female flange having an inward-facing conically tapered sealing surface; a male flange having an outward-facing conically tapered sealing surface; and a seal ring having an outward-facing conically tapered surface complementary to the sealing surface of the female flange; and an inward-facing conically tapered surface complementary to the sealing surface of the male flange;

where the seal ring is positioned between the male and female flanges with the conically tapered surfaces of the seal ring in contact with the complementary sealing surfaces of the male and female flanges and the male and female flanges are coupled together to form a connection between the primary lumen of the main tube and the fitting lumen of the fitting; where one of the collar and the fitting defines the female flange, and the other of the collar and the first defines the male flange; and where an interface between male flange and the female flange is substantially free of gaps.

In some embodiments of the present riser segment assemblies, the collar defines a second lateral opening in fluid communication with the primary lumen of the main tube, and the assembly further comprises: a second valve coupled to the second lateral opening, the second valve having a longitudinal flow axis that is more parallel than perpendicular to a longitudinal axis of the main tube. Some embodiments further comprise: a second fitting coupled to the collar over the second lateral opening and to the second valve, the second fitting defining a fitting lumen in fluid communication with the second lateral opening. In some embodiments, the present riser segment assemblies are located in a riser stack between an isolation unit and a formation.

Some embodiments of the present riser segment assemblies comprise: a main tube defining a primary lumen; a collar defining a lateral opening in fluid communication with the primary lumen; and a fitting coupled to the collar over the lateral opening and configured to be removably coupled to a valve assembly, the fitting defining a fitting lumen in fluid communication with the lateral opening. Some embodiments further comprise: two flanges each coupled to a different end of the main tube, each flange comprising: a mating face configured to mate with a flange of an adjacent riser segment; and a central flange lumen configured to be in fluid communication with the primary lumen of the main tube. In some embodiments, the collar is unitary with one of the two flanges. In some embodiments, the lateral opening is not threaded. In some embodiments, the fitting includes a recess configured to receive a portion of the valve assembly without threads or welding to permit fluid communication between the fitting lumen and the valve assembly. In some embodiments, the recess of the fitting that is configured to receive the portion of the valve assembly has a longitudinal axis that is substantially parallel to a longitudinal axis of the main tube.

Some embodiments of the present riser segment assemblies further comprise: a valve assembly comprising a first connector configured to be inserted into the recess of the fitting, a second connector configured to be coupled to the main tube, and a valve disposed between the first connector and the second connector. In some embodiments, the valve comprises a double-ball valve. In some embodiments, the second connector defines a lumen having an inlet through which fluid can enter the second connector in a first direction, and an outlet through which fluid can exit the second connector in a second direction that is different than the first direction. In some embodiments, the second direction is substantially opposite the first direction. In some embodiments, the second connector further comprises a secondary lumen with a second exit sealed by a removable cover, the second exit configured such that if the cover is removed, fluid can exit the connector in a third direction that is different than the first direction and the second direction. Some embodiments further comprise: a retainer coupled to the main tube and configured releasably engage the second connector without welding to secure the second connector in fixed relation to the first fitting and the main tube. In some embodiments, the retainer includes a body having a recess configured to receive a portion of the second connector to restrict lateral movement of the second connector relative to the main tube. In some embodiments, the retainer includes one or more movable members pivotally coupled to the body and movable between an open position in which the second connector is permitted to enter or exit the recess of the body, and a closed position in which the one or more movable members prevent the second connector from entering or exiting the recess of the body.

In some embodiments of the present riser segment assemblies, the maximum transverse dimension of the assembly is less than 60.5 inches. In some embodiments, the maximum transverse dimension of the assembly is greater than 60.5 inches if the valve assembly is coupled to the fitting, and is less than 60.5 inches if the valve assembly is not coupled to the fitting. In some embodiments, the first fitting and the collar are configured to form a substantially gapless connection comprising: a female flange having an inward-facing conically tapered sealing surface; a male flange having an outward-facing conically tapered sealing surface; and a seal ring having an outward-facing conically tapered surface complementary to the sealing surface of the female flange; and an inward-facing conically tapered surface complementary to the sealing surface of the male flange; where the seal ring is positioned between the male and female flanges with the conically tapered surfaces of the seal ring in contact with the complementary sealing surfaces of the male and female flanges and the male and female flanges are coupled together to form a connection between the primary lumen of the main tube and the fitting lumen of the first fitting; where one of the collar and the first fitting defines the female flange, and the other of the collar and the first defines the male flange; and where an interface between male flange and the female flange is substantially free of gaps.

In some embodiments of the present riser segment assemblies, the collar defines a second lateral opening in fluid communication with the primary lumen of the main tube, and the assembly further comprises: a second fitting coupled to the collar over the second lateral opening and configured to be removably coupled to a valve assembly, the fitting defining a fitting lumen in fluid communication with the lateral opening. In some embodiments, the second fitting is substantially similar to the first fitting. In some embodiments, the present riser segment assemblies are located in a riser stack between an isolation unit and a formation.

Some embodiments of the present methods comprise: lowering an embodiment of the present riser segment assemblies through a rotary of a drilling rig. Some embodiments further comprise: connecting, below the rotary, one of the present second connectors to the riser segment assembly without welding; and/or connecting, below the rotary, one of the present valve assemblies to the riser segment assembly without welding.

The term "coupled" is defined as connected, although not necessarily directly, and not necessarily mechanically; two items that are "coupled" may be unitary with each other. The terms "a" and "an" are defined as one or more unless this disclosure explicitly requires otherwise. The term "substantially" is defined as largely but not necessarily wholly what is specified (and includes what is specified; e.g., substantially 90 degrees includes 90 degrees and substantially parallel includes parallel), as understood by a person of ordinary skill in the art. In any disclosed embodiment, the terms "substantially," "approximately," and "about" may be substituted with "within [a percentage] of" what is specified, where the percentage includes 0.1, 1, 5, and 10 percent.

Further, a device or system that is configured in a certain way is configured in at least that way, but it can also be configured in other ways than those specifically described.

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, an apparatus that "comprises," "has," "includes" or "contains" one or more elements possesses those one or more elements, but is not limited to possessing only those elements. Likewise, a method that "comprises," "has," "includes" or "contains" one or more steps possesses those one or more steps, but is not limited to possessing only those one or more steps.

Any embodiment of any of the apparatuses, systems, and methods can consist of or consist essentially of—rather than comprise/include/contain/have—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb.

The feature or features of one embodiment may be applied to other embodiments, even though not described or illustrated, unless expressly prohibited by this disclosure or the nature of the embodiments.

Details associated with the embodiments described above and others are described below.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers. The figures are drawn to scale for at least the embodiments shown.

DESCRIPTION OF ILLUSTRATIVE EMBODIMENTS

Figure 1:
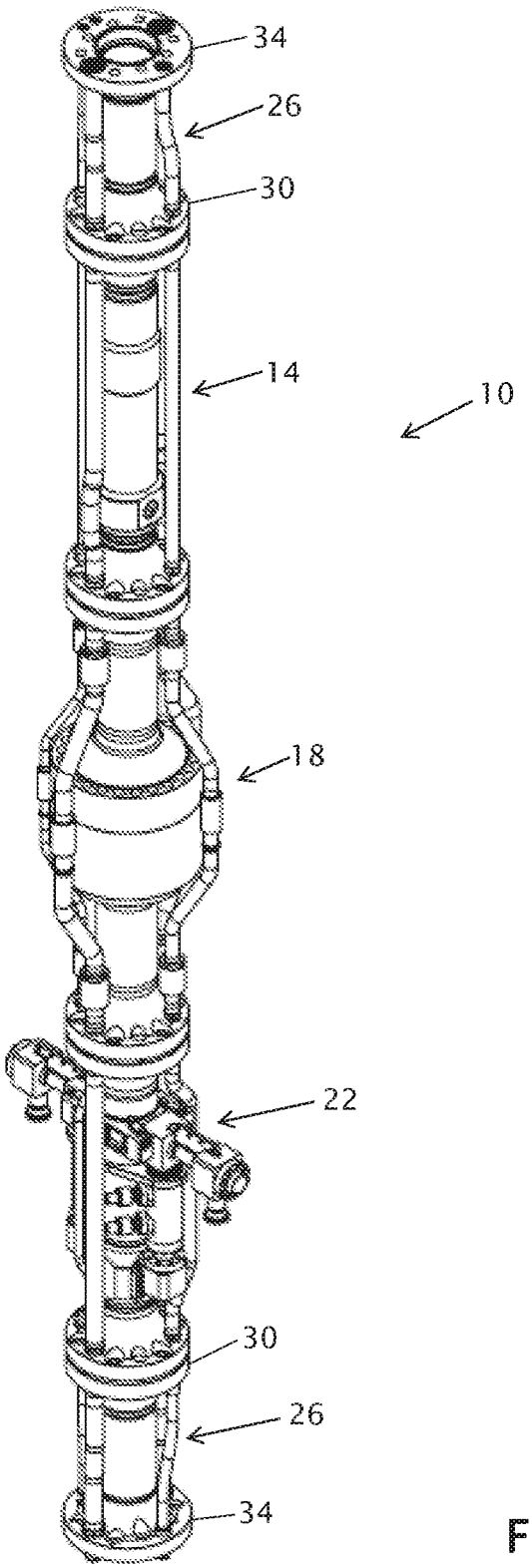
FIG. 1 depicts a perspective view of a riser stack including an embodiment of the present flow spool riser segment assemblies.

Referring now to the drawings, and more particularly to FIG. 1, shown there and designated by the reference numeral 10 is one embodiment of a riser assembly or stack that includes multiple riser segments. In the embodiment shown, assembly 10 includes a rotating control device (RCD) body segment 14, an isolation unit segment 18, a flow spool segment 22, and two crossover segments 26 (one at either end of assembly 10). In this embodiment, crossover segments 26 each has a first type of flange 30 at an inner end (facing segments 14, 18, 22) a second type of flange 34 at an outer end (facing away from segments 14, 18, 22). Flanges 30 can, for example, include a proprietary flange design and flanges 34 can, for example, include a generic flange design, such that crossover segments 26 can act as adapters to couple segments 14, 18, 22 to generic riser segments with others types of flanges. Crossover segments 26 are optional, and may be omitted where riser segments above and below segments 14, 18, 22 have the same type of flanges as segments 14, 18, 22.

FIGS. 2-6 show the depicted embodiment of flow spool segment assembly 18 in more detail. In this embodiment, assembly 18 comprises: a main tube 100 having a first end 104 and a second end 108 and defining a primary lumen 110; and two flanges 112*a* and 112*b* each coupled to a different end of the main tube. In this embodiment, each flange 112*a*, 112*b* includes a mating face 116 configured to mate with a flange of an adjacent riser segment (e.g., via bolts extending through bolt holes 118); a central lumen 120 configured to be in fluid communication with main tube 100; and at least one auxiliary hole 124 configured to receive an auxiliary line 128. In the embodiment shown, assembly 18 includes a plurality of auxiliary lines 128 and each flange 112*a*, 112*b* includes a plurality of auxiliary holes 124, each configured to receive a different one of the auxiliary lines. One example of a flange design (for flanges 112*a* and 112*b*) that is suitable for at least some embodiments is described in U.S. Provisional Application No. 61/791,222, filed Mar. 15, 2013, which is incorporated by reference in its entirety. In the embodiment shown, each auxiliary line 128 extends between a female fitting 132 sized to fit within the corresponding one of auxiliary holes 124 of flange 112*a*, and a male fitting 136 sized to fit within the corresponding one of auxiliary holes 124 of flange 112*b*. Fittings 132 and 136 can be coupled to the respective flanges 112*a* and 112*b* via welds, threads, and/or the like (e.g., via external threads on fittings 132 and 136 that correspond to internal threads of the respective flange 112*a* or 112*b* in the corresponding auxiliary hole (124). Female fitting 132 is configured to slidably receive a corresponding male fitting (e.g., 136) in an adjacent riser segment to provide a connection between the corresponding auxiliary lines of adjacent riser segments. Likewise, male fitting 136 is configured to be slidably received in a corresponding female fitting (e.g., 132) of an adjacent riser segment to provide a connection between the corresponding auxiliary lines of adjacent riser segments. Female fitting 132 can include, for example, internal grooves configured to receive sealing and/or lubricating components (e.g., O-rings, rigid washers, grease, and/or the like) to facilitate insertion of a male fitting into the female fitting and/or improve the seal between the male and female fittings of adjacent riser segments. For clarity and brevity, auxiliary lines are omitted from FIGS. 4A-5B.

In the embodiment shown, assembly 22 also comprises a collar 140 defining a lateral opening 144 in fluid communication with primary lumen 110. Collar 140 includes a mating surface around lateral opening 144 to which fitting 164 is coupled, as described below. In the embodiment shown, collar 140 is welded to an end of a pipe 146 such that the collar and the pipe cooperate to form main tube 100 and primary lumen 110. In other embodiments, the collar may be disposed (e.g., concentrically) around the pipe, or the collar may be unitary with flange (e.g., 112*b*).

In this embodiment, the assembly also comprises a valve 148 coupled to lateral opening 144 and having a longitudinal flow axis 152 that is more parallel than perpendicular to a longitudinal axis 156 of the main tube. For example, in the embodiment shown, valve 148 comprises a double ball valve having an elongated body 160, as shown. While certain details of the double ball valve are omitted from the figures for clarity and brevity, various valves are commercially available that may be used in the present embodiments. One example of a double ball valve that is suitable for at least some of the present embodiments is part number JB503 offered by Piper Valves, an Oil States Company. The embodiment shown includes two substantially similar (e.g., identical) valves 148 and corresponding structures. As such, while only one valve and corresponding structure will generally be described below, it should be understood that the description is provided below is accurate for the corresponding second set of structures shown in the figures. Other embodiments may include only a single valve and corresponding structures (e.g., only a single lateral opening 144).

In the embodiment shown, lateral opening 144 is not threaded and need not be threaded to connect valve 148 to lateral opening 144. Instead, assembly 22 comprises a fitting 164 coupled to collar 140 over lateral opening 144 and coupled to valve 148 (e.g., via bolts 162). In the embodiment shown, fitting 164 defines a fitting lumen 168 in fluid communication with lateral opening 144. In this embodiment, fitting lumen 168 defines an elbow (e.g., a 90-degree bend) that includes a first portion 172 that is substantially perpendicular to axis 156, and a second portion 176 that is substantially parallel to axis 156. In the embodiment shown, fitting 164 and collar 140 are configured to include a TaperLok® connection, as described in U.S. Pat. No. 7,748,751. In particular, in this embodiment, collar 140 includes a female flange or mating surface 141 having an inward-facing conically tapered sealing surface 142; and fitting 164 includes a male flange or mating surface 165 having an outward-facing conically tapered sealing surface 166. In this embodiment, a seal ring (not shown here but illustrated in the figures of U.S. Pat. No. 7,748,751, which are incorporated by reference) having an outward-facing conically tapered surface complementary to surface 141 and an inward-facing conically tapered surface complementary to surface 166 is positioned between male and female flanges 141 and 165 with the conically tapered surfaces of the seal ring in contact with the complementary sealing surfaces 141 and 165. Fitting 164 (and surface 165) is coupled to collar 140 (and surface 141) to form a connection between primary lumen 110 of the main tube and fitting lumen 168 of the fitting, and such that the interface between male flange 141 and female flange 165 is configured to be substantially free of gaps. In this embodiment, a connector 180 is secured (e.g., by bolts 184) to fitting 164 and secured (e.g., by bolts 188) to a first end 192 of valve body 160 to provide a sealed connection between valve 148 and fitting 164.

Figure 3A:
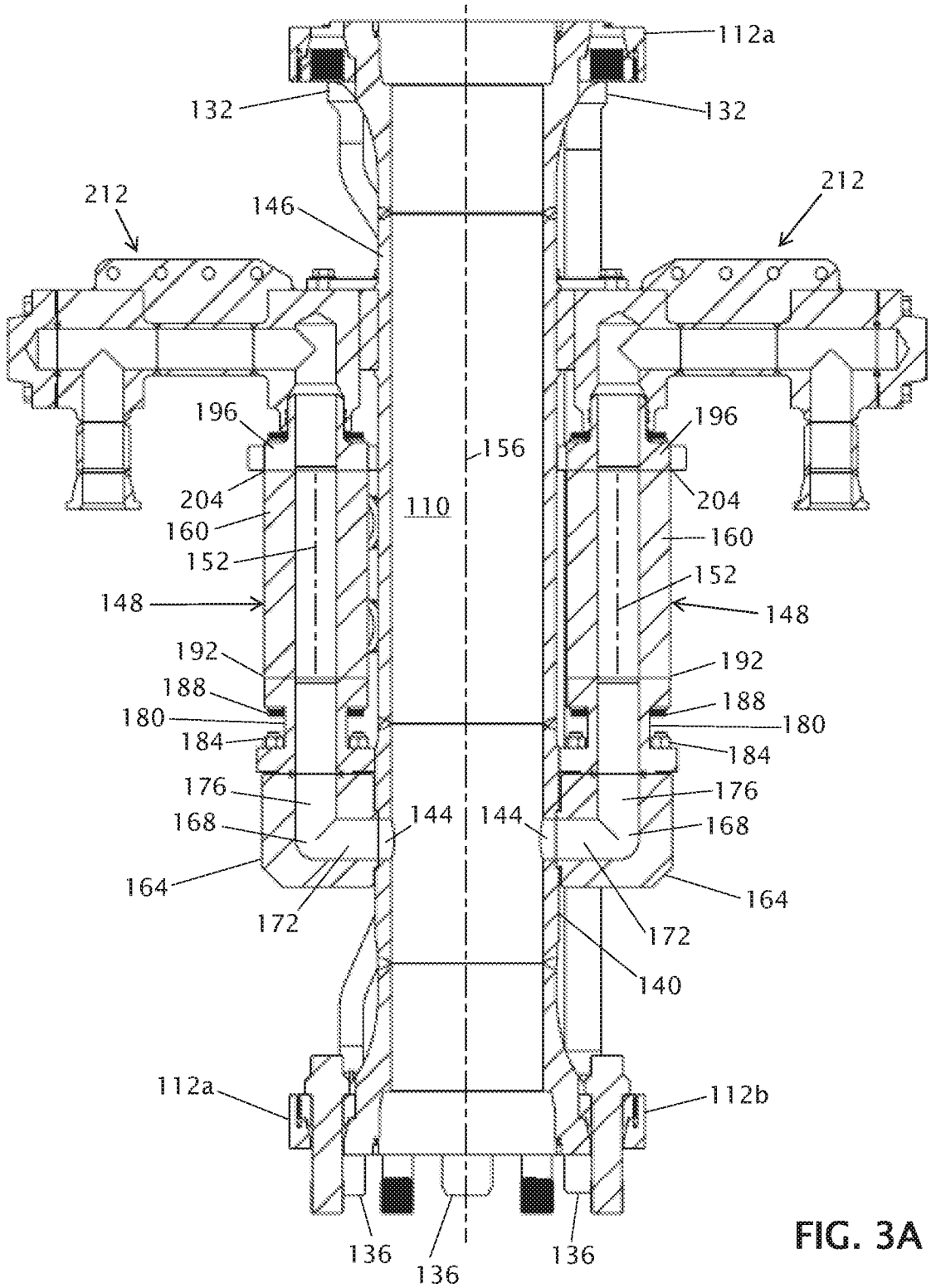
FIG. 3A depicts a cross-sectional view of the flow spool riser segment assembly of FIG. 2.
Figure 3B:
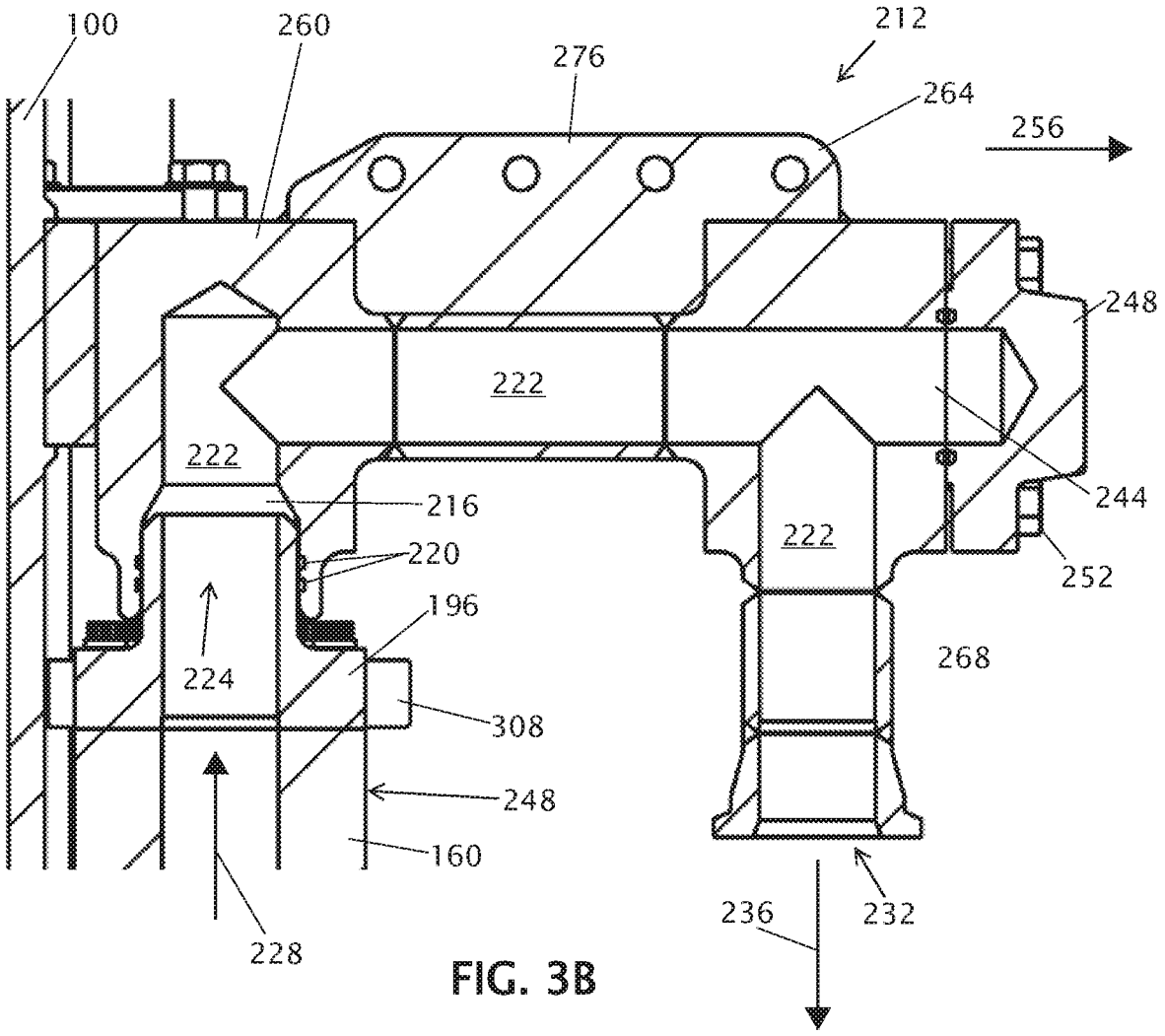
FIG. 3B depicts an enlarged cross-sectional view of a portion of the flow spool riser segment assembly of FIG. 2.
Figure 4A:
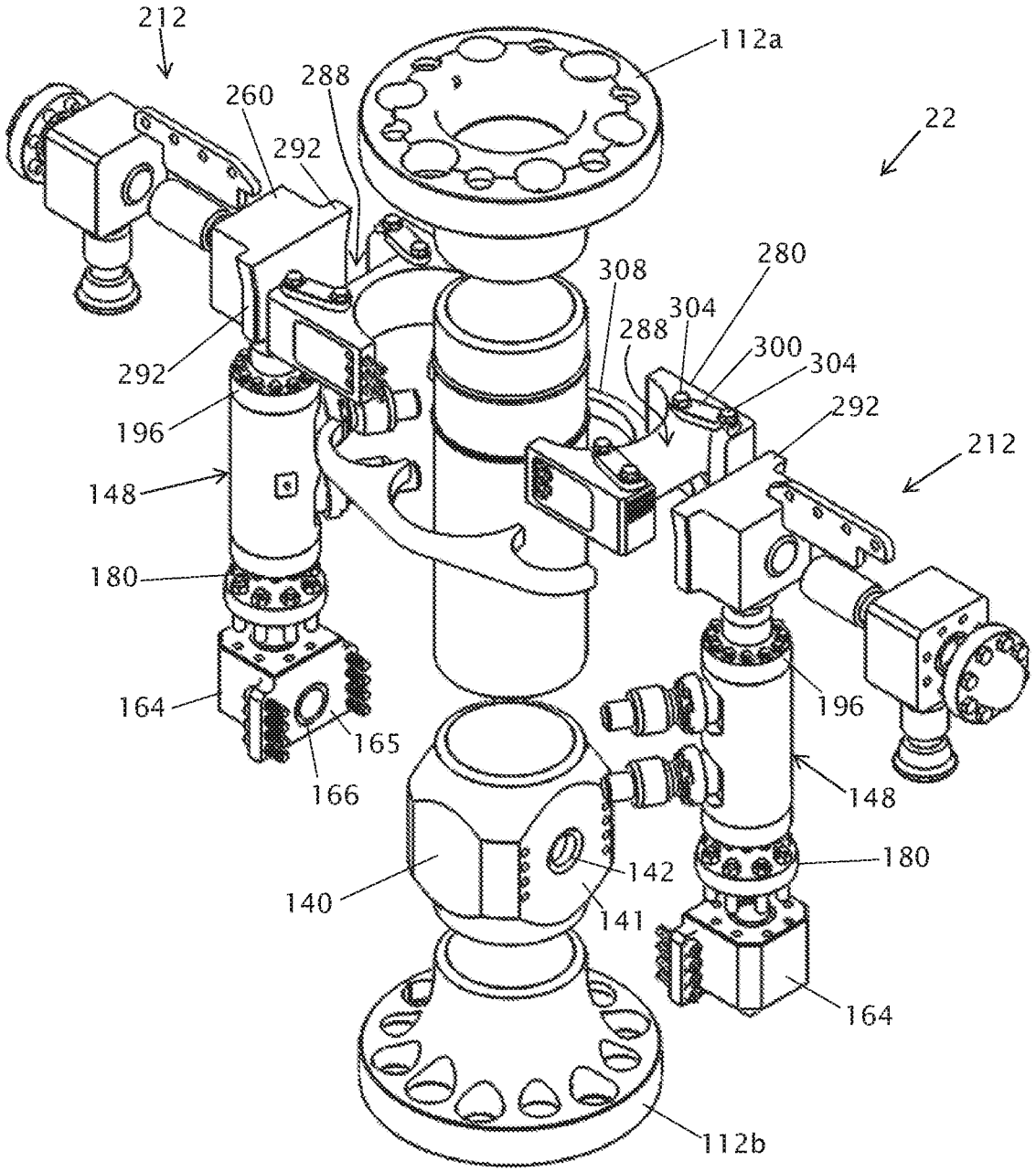
FIGS. 4A and 4B depict exploded perspective and side views, respectively, of the flow spool riser segment assembly of FIG. 2.
Figure 4B:
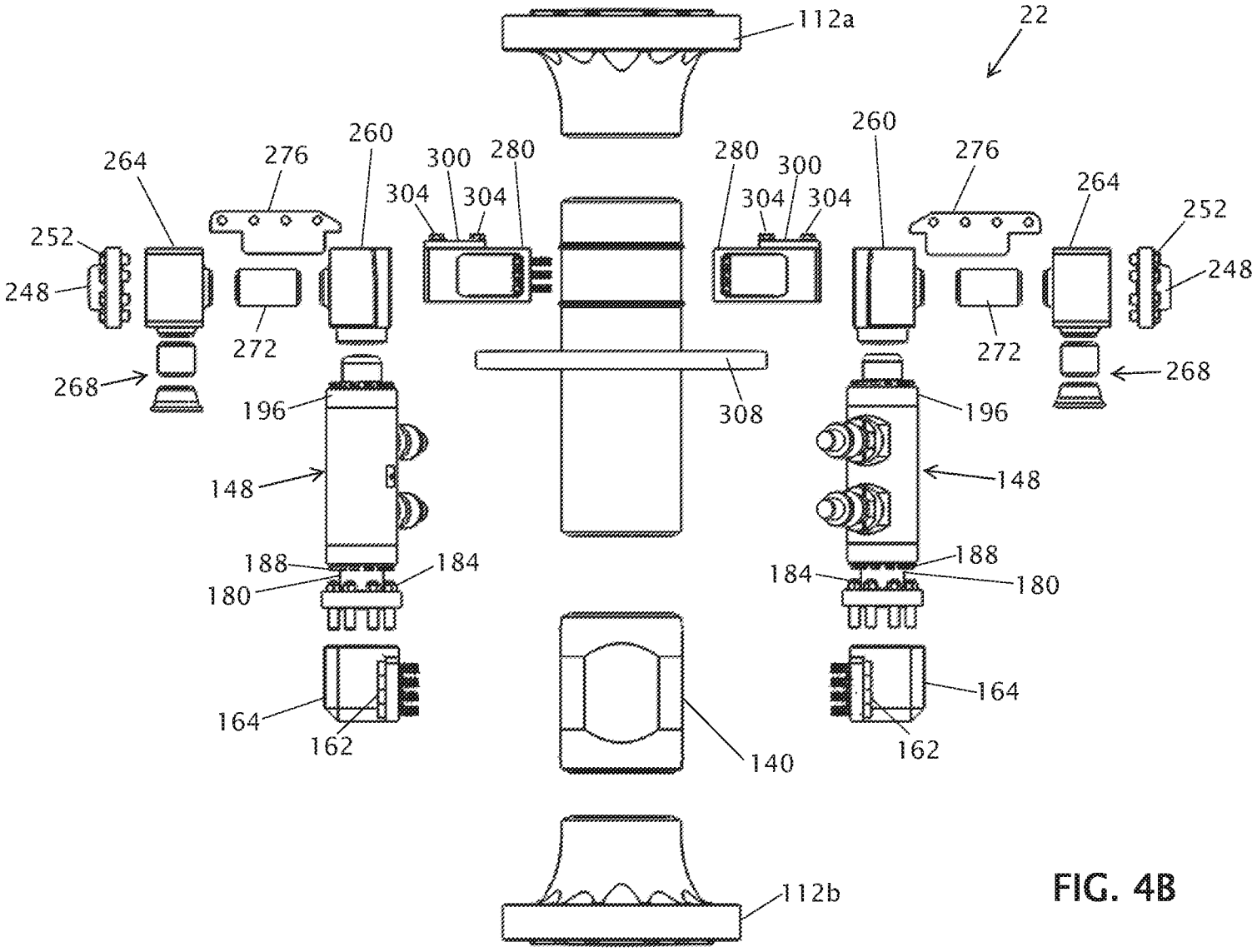

In this embodiment, and as shown in greater detail in FIG. 3B, a second connector 196 is secured (e.g., by bolts 200) to a second end 204 of valve body 160 and has a protrusion 208 (e.g., having a circular cross-sectional shape as shown). In the embodiment shown, assembly 22 also includes a third connector 212 configured to be coupled to the main tube (100) and defining a recess 216 configured to slidably receive protrusion 208 of second connector 196 to provide a sealed connection between second connector 196 and third connector 212. In the embodiment shown, third connector 212 includes internal grooves 220 around recess 216 that are configured to receive sealing and/or lubricating components (e.g., O-rings, rigid washers, grease, and/or the like) to facilitate insertion of protrusion 208 into the recess 216 and/or improve the seal between second connector 196 and third connector 212. In this embodiment, third connector 212 defines a lumen 222 having an inlet 224 through which fluid can enter the third connector in a first direction 228, and an outlet 232 through which fluid can exit the third connector in a second direction 236 that is different than (e.g., substantially opposite to) first direction 228. For example, in the embodiment shown, lumen 222 is U-shaped such that first direction 228 is substantially opposite to second direction 236. In the embodiment shown, third connector 212 further defines a secondary lumen 240 with a second exit 244 sealed by a removable cover 248 (e.g., secured by bolts 252), and second exit 244 is configured such that if cover 248 is removed, fluid can exit third connector 212 in a third direction 256 that is different than (e.g., substantially perpendicular to) first direction 228 and second direction 236.

In the embodiment shown, third connector 212 includes an elbow fitting 260, a tee fitting 264, cover 248 bolted to tee fitting, a nozzle or connection 268 welded to tee fitting, a conduit 272 extending between and welded to fittings 260 and 264, and a brace 276 extending along the length of conduit 272 and welded to fittings 260, 264 and to conduit 272. In other embodiments, connector 212 can have any suitable components or construction that permits assembly 22 to function as described in this disclosure.

In the embodiment shown, the connection (protrusion 208 of second connector 196 and recess 216 of third connecter 212) enables removal of third connector 212 from second connector 196 by simply moving third connector 212 in direction 228 away from second connector 196. As such, third connector 212 can be readily removed from the remainder of assembly 22 to permit the remainder of assembly 22 to be lowered through a rotary of a drilling rig, as described in more detail below. Likewise, if assembly 22 is included in a riser stack that is used for conventional drilling operations, there may be no need to attach third connector 212 to assembly 22 and valve 148 can be kept closed and third connector 212 can simply be omitted during use (e.g., but available for later MPD operations using the same riser stack).

However, during shipping and/or use during MPD operations (e.g., after assembly 22 has been lowered through a rotary), it is generally desirable to prevent removal of third connector 212. In the embodiment shown, and as shown in detail in FIGS. 5A and 5B (in which flange 112*a*, including its neck portion, is omitted for clarity), assembly 22 includes a retainer 280 coupled to main tube 100 and configured releasably engage third connector 212 without welding to secure the third connector in fixed relation to the main tube. In particular, retainer 280 includes a body 284 having a recess 288 configured to receive a portion of third connector 212 (fitting 260) to restrict lateral movement of the third connector relative to main tube 100. In this embodiment, fitting 260 includes a T-shaped cross-section with lateral protrusions 292, and recess 288 includes lateral grooves or slots 296 configured to receive protrusions 292 to prevent fitting 260 (and third connector 212) from moving radially outward relative to retainer 280 (and main tube 100). Additionally, the T-shaped cross-section of fitting 260 (and the corresponding T-shaped cross-section of recess 288) tapers from a larger top to a smaller bottom (top' and 'bottom' in the depicted orientation of assembly 18) facilitate insertion of fitting 260 into recess 288 and restrain downward vertical freedom of third connector 212 relative to retainer 280. In other embodiments, fitting 260 and recess 280 can have any cross-sectional shape(s) that enable assembly 22 to function as described in this disclosure. In this embodiment, retainer 280 includes two identical body members that are bolted together around main tube 100 as shown.

Figure 5A:
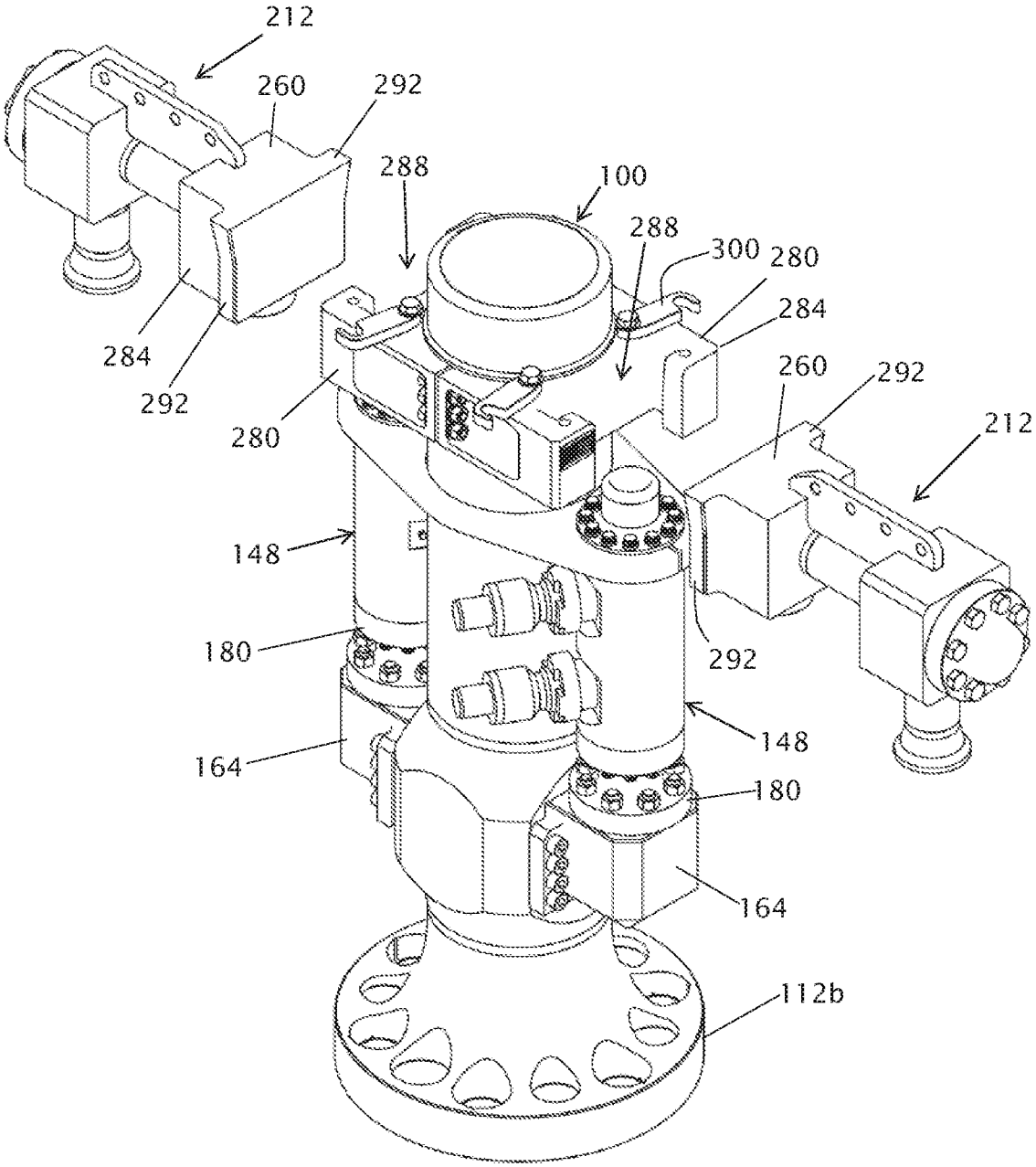
FIGS. 5A and 5B depict partially disassembled, cutaway perspective and top views, respectively, of the riser segment assembly of FIG. 2.
Figure 5B:
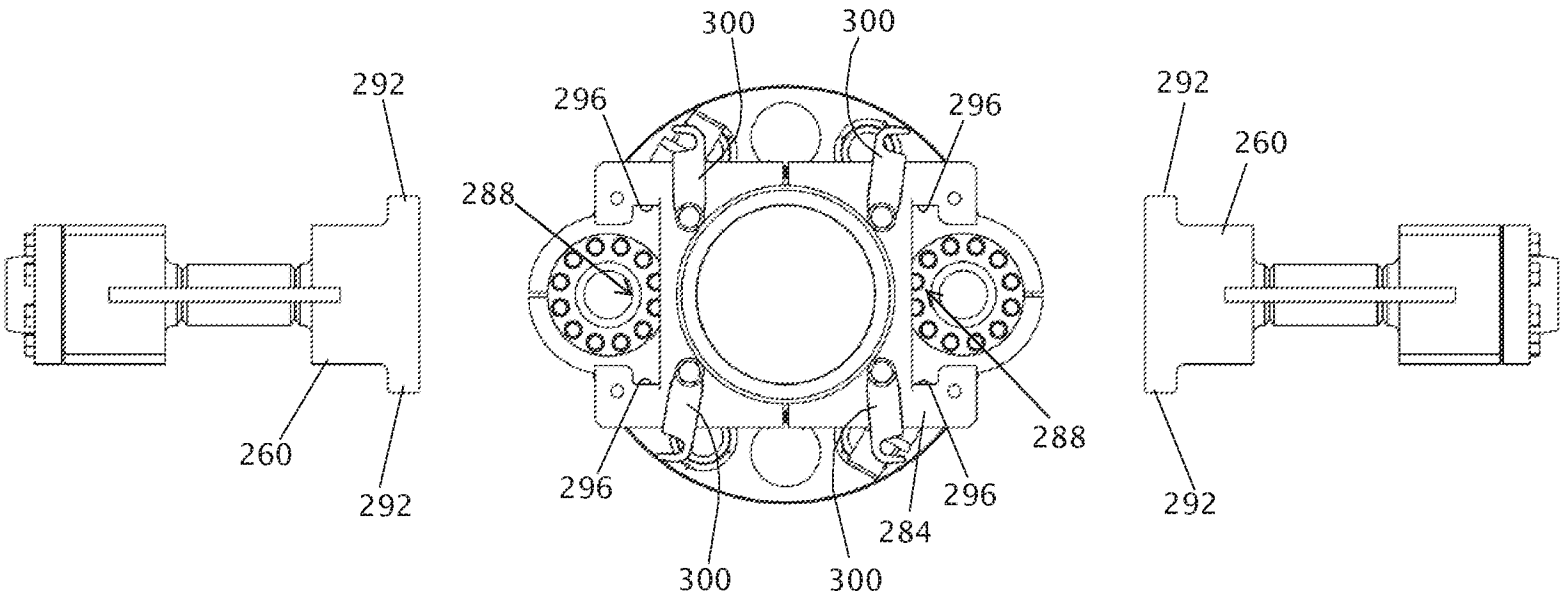
Figure 6:
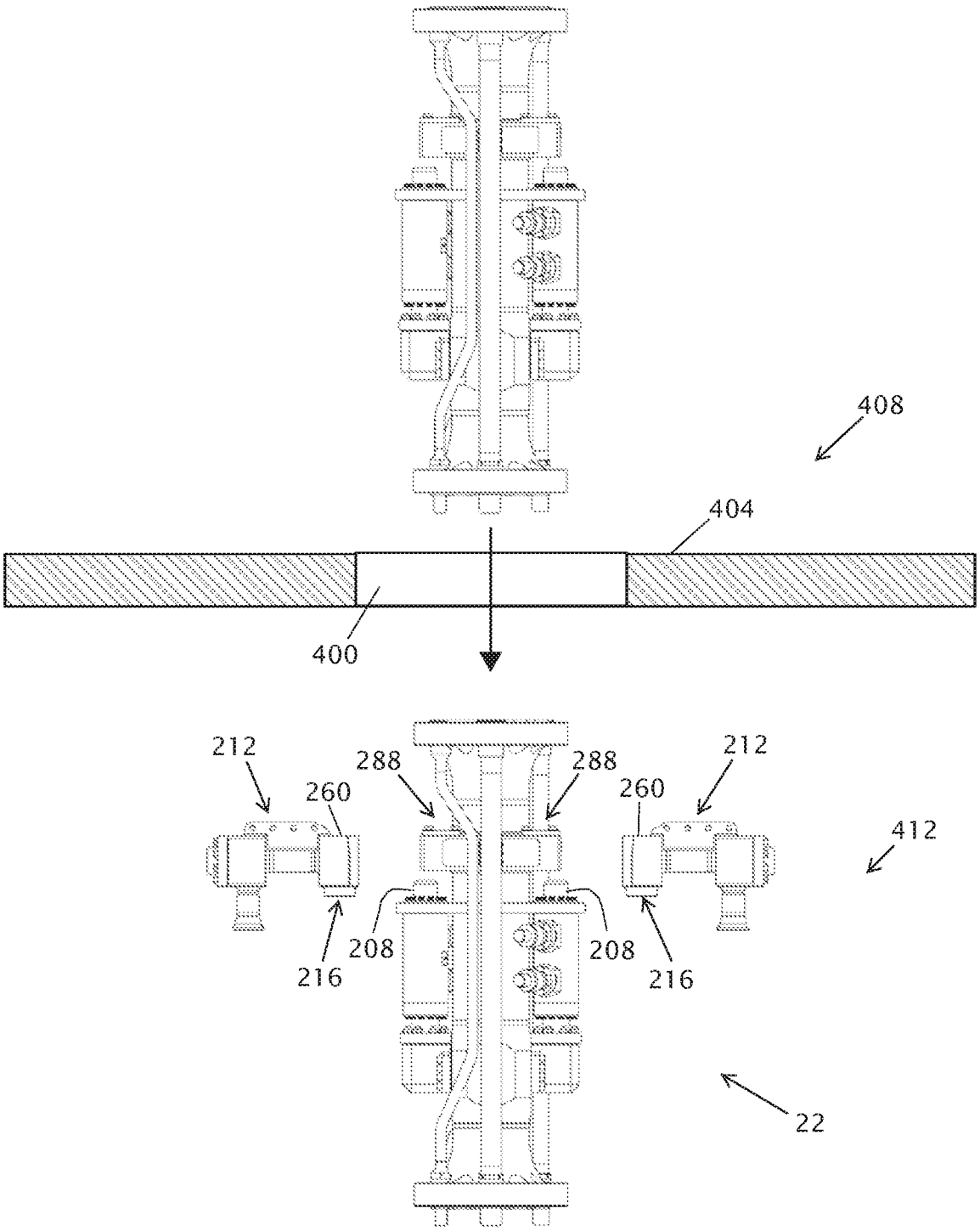
FIG. 6 depicts a side view of the riser segment assembly of FIG. 2 being lowered through a rotary and partially assembled below the rotary in accordance with some embodiments of the present methods.
Figure 7:
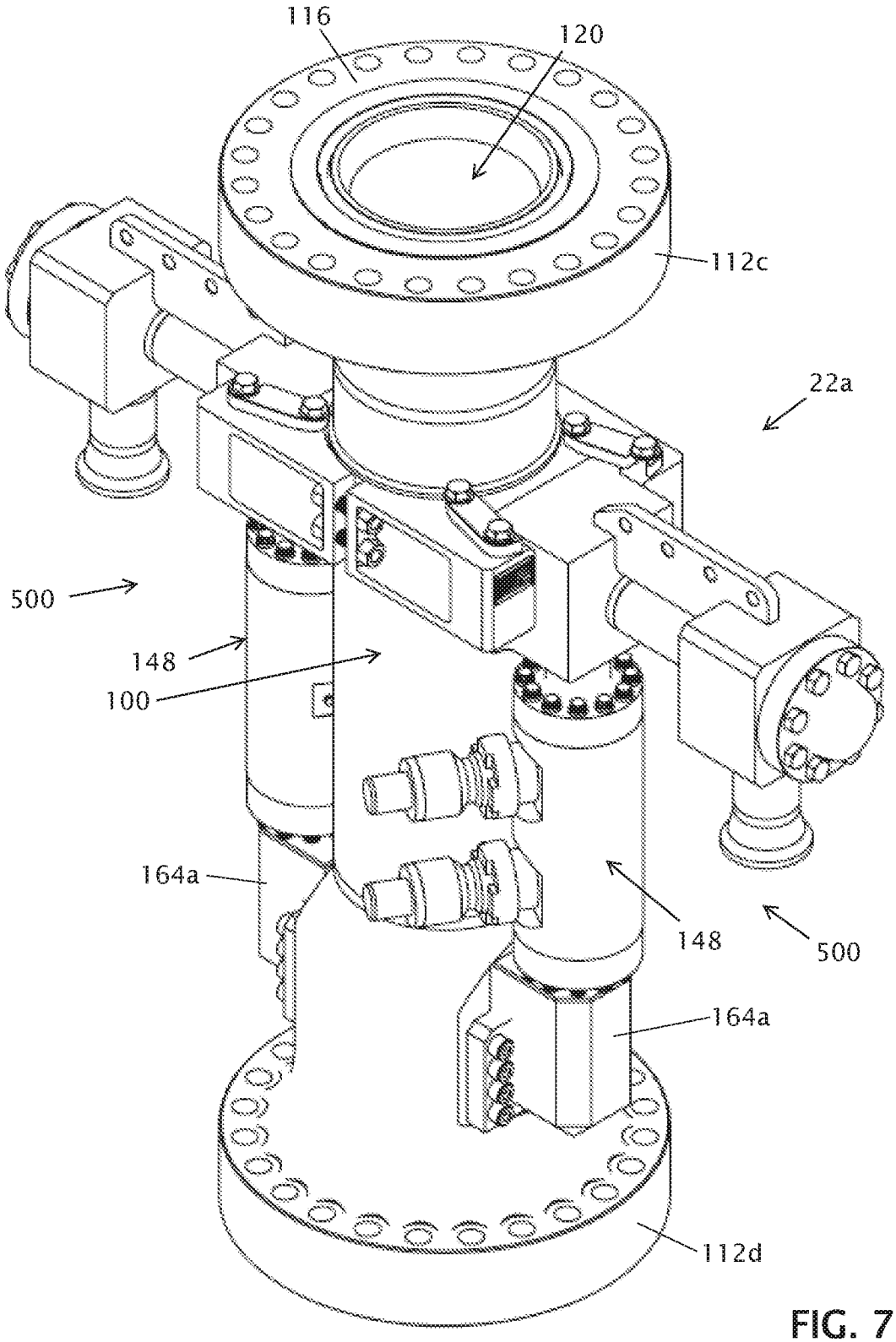
FIG. 7 depicts a perspective view of a second embodiment of the present riser segment assemblies that includes an isolation unit.
Figure 8A:
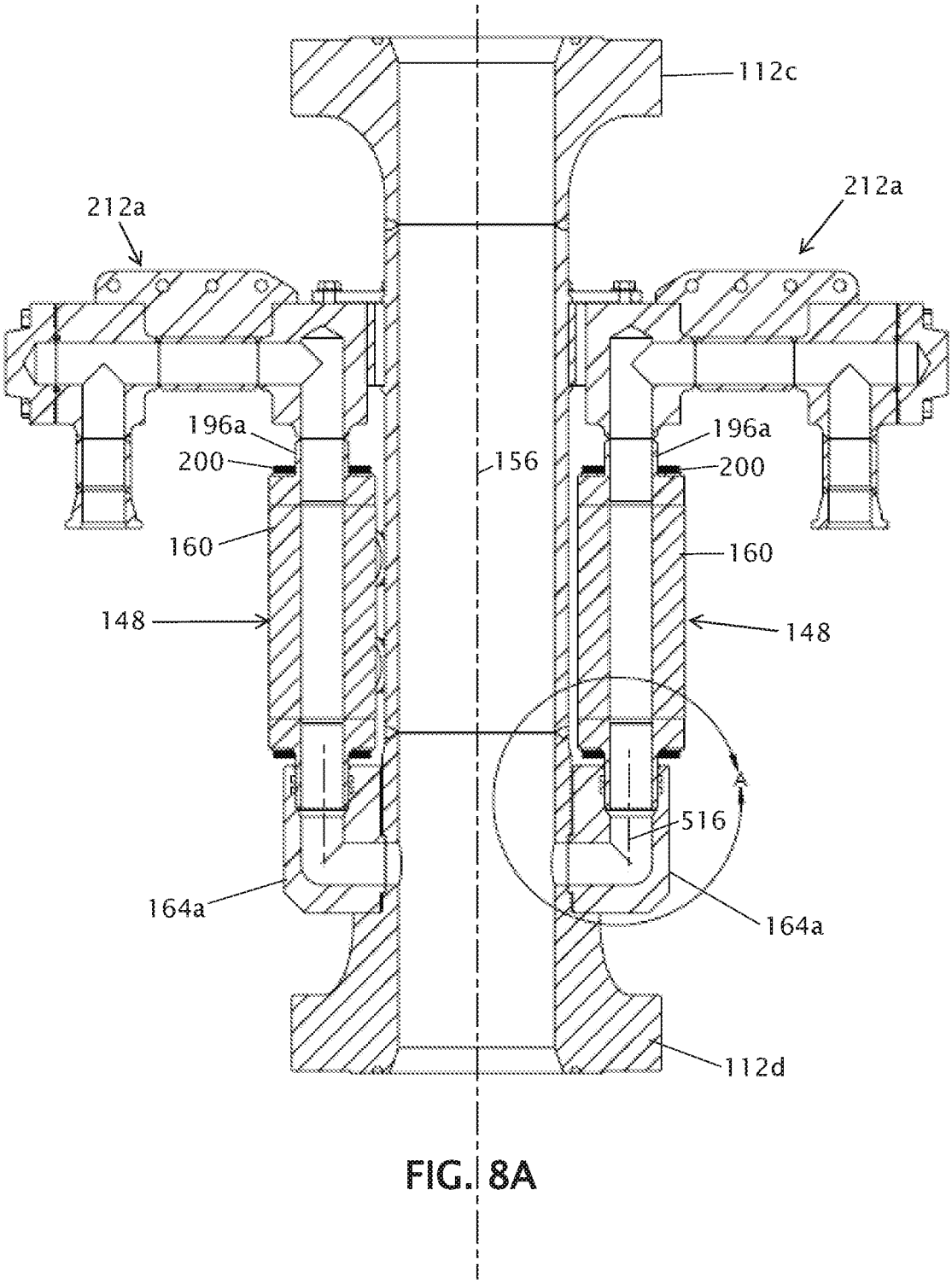
FIG. 8A depicts a cross-sectional view of the flow spool riser segment assembly of FIG. 7.
Figure 8B:
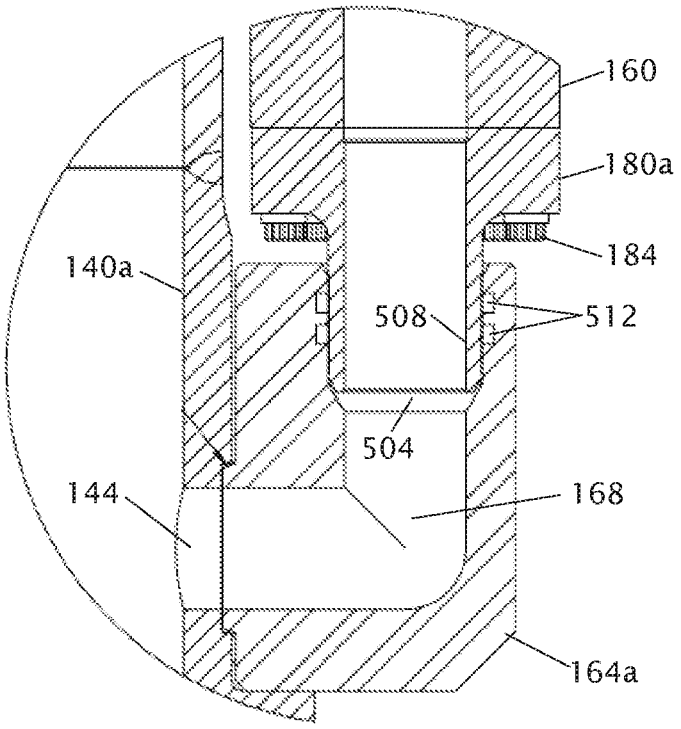
FIG. 8B depicts an enlarged cross-sectional view of a portion of the flow spool riser segment assembly of FIG. 7.
Figure 9A:
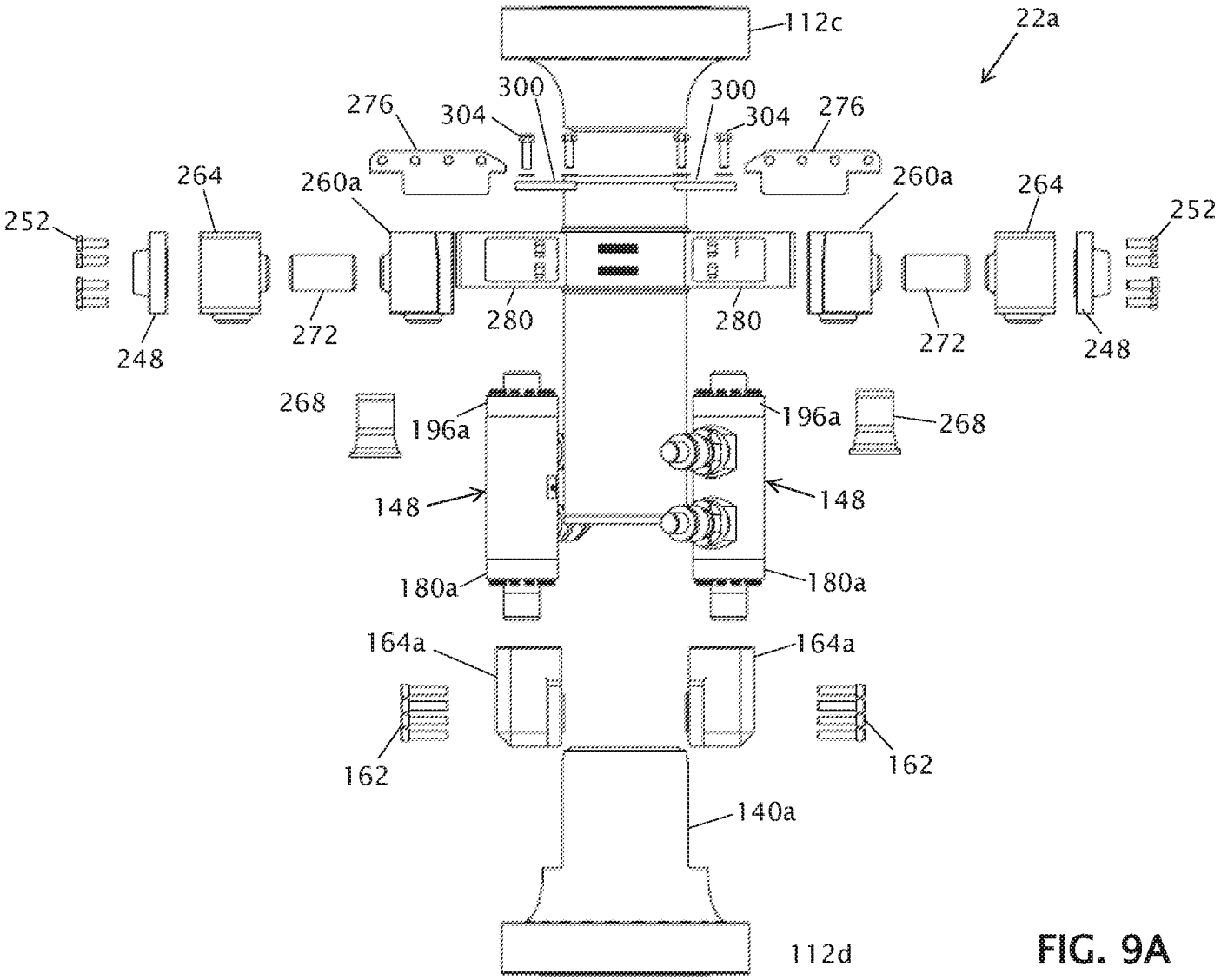
FIGS. 9A and 9B depicts exploded side and perspective views, respectively, of the flow spool riser segment assembly of FIG. 7.
Figure 9B:
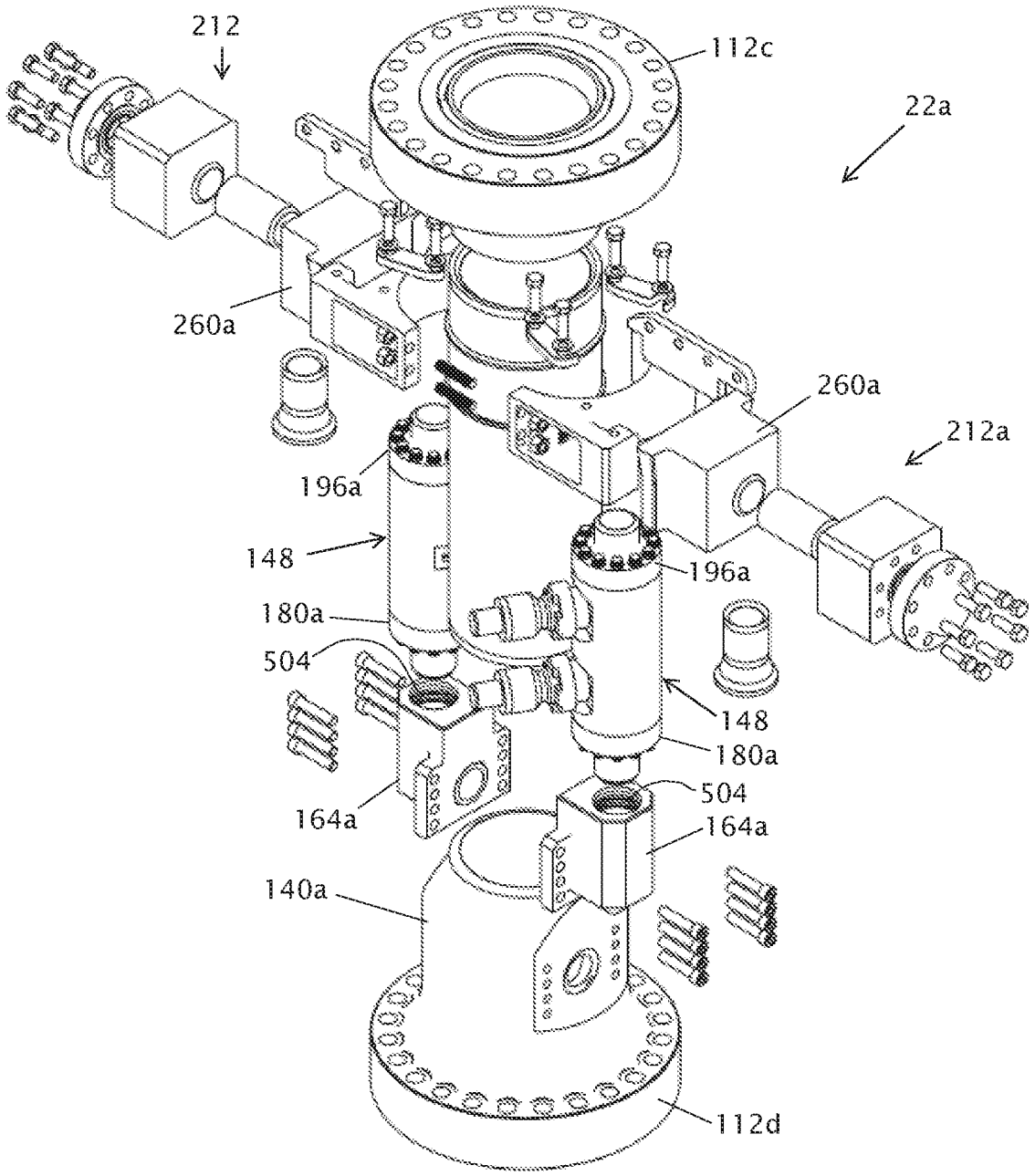

In the embodiment shown, retainer 280 also includes one or more (e.g., two, as shown) movable members 300 pivotally coupled (e.g., via bolts 304) to the body and movable between an open position (FIGS. 5A-5B) in which third connector 212 is permitted to enter or exit recess 288 of body 284, and a closed position (FIGS. 2, 4A-4B) in which movable members 300 prevent the third connector from entering or exiting the recess of the body. More particularly, in the embodiment shown, each member 300 includes a hole through a first end and a slot in an opposing end, such that bolts 304 can be loosened and members 300 pivoted laterally outward as shown in FIGS. 5A-5B to permit fitting 260 to be vertically removed from or inserted into recess 288 of retainer 280, and such that members 300 can be pivoted laterally inward such that the slots of the members fit over the shanks of bolts 304 and bolts 304 can be tightened to secure members 300 in their closed position of FIGS. 2 and 4A-4B.

In the embodiment shown, assembly 22 further includes a stabilizer 308 configured to stabilize valve 148 and second connector 196 relative to main tube 100. In this embodiment, stabilizer extends around main tube 100 and second connector 196 to rigidly fix the position of second connector 196 (and valve 148) relative to the main tube. In this embodiment, stabilizer 308 includes two identical body members that are bolted together around main tube 100 as shown.

Figure 2:
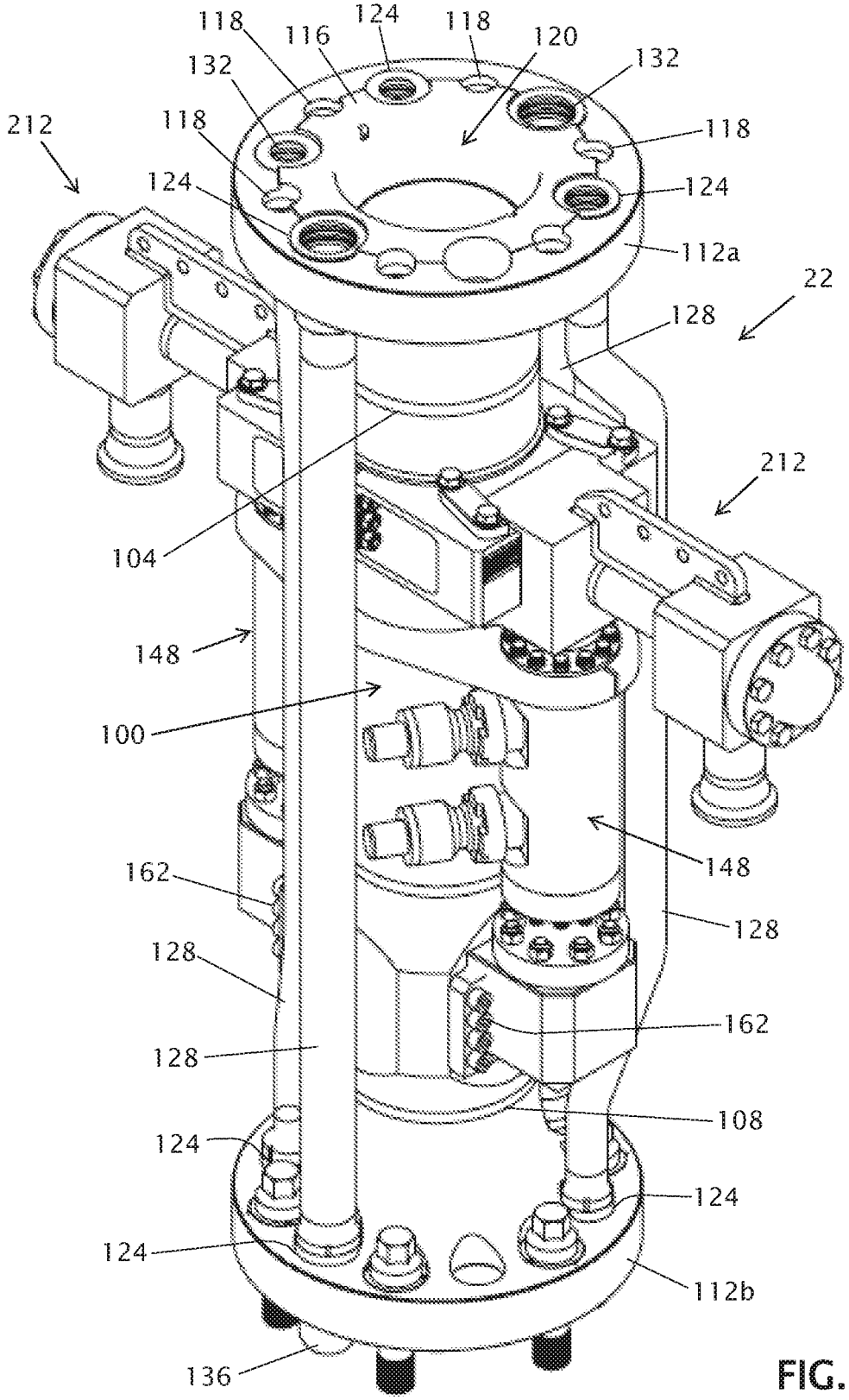
FIG. 2 depicts a perspective view of an embodiment of the present flow spool riser segment assemblies.

As discussed above, assembly 22 is configured to be lowerable through a rotary of a drill rig when third connectors 212 are removed. For example, FIGS. 5A-5B show assembly 22 in a partially disassembled state in which third connectors 212 are removed. In this state, the maximum transverse dimension of assembly 22 (e.g., defined by stabilizer 308 for the embodiment shown) is less than 60.5 inches, which is a common diameter for a rotary on various drilling rigs (often referred to as a 60-inch rotary). Other embodiments of assembly 22 can have a different maximum transverse dimension (e.g., greater than 60.5 inches). For example, some rotaries have diameters greater than 60.5 inches (e.g., 75 inches). In this state, and in accordance with some of the present methods, the majority of assembly 22 (without third connectors 212) can be passed through a rotary 400 (e.g., in an upper deck 404) of a drilling rig 408, and third connectors 212 can be connected (e.g., without welding) below rotary 400, such as, for example, by a person standing in a mezzanine level 412 of the drilling rig. In particular, each sliding fitting 260 can be inserted into recess 288 of retainer 280 while protrusion 208 of second connector 196 is simultaneously received in recess 216 of fitting 260. Once fittings 260 are disposed in recess 288 (and connectors 212 are secured as shown in FIG. 2, members 300 can be pivoted inward and secured by bolts 304 to prevent removal of third connectors 212. In this fully assembled state, the maximum transverse dimension of the depicted assembly 22 is greater than 60.5 inches such that ability to remove connectors 212 facilitates lowering assembly 22 through a rotary in way that would otherwise not be possible.

FIGS. 7-11 depict a second embodiment 22*a* of flow spool riser segment assembly that can be included in assembly 10 of FIG. 1 (e.g., additional or alternative to isolation flow spool segment assembly 22). Assembly 22*a* is similar in many respects to assembly 22 and the differences are therefore primarily described here. For example, assembly 22*a* differs from assembly 22 in that assembly 22*a* does not include auxiliary lines or a stabilizer (e.g., 308), includes generic flanges 112*c* and 112*d*, and collar 140*a* is unitary with flange 112*d* (e.g., with the neck portion of flange 112*d*). Assembly 22*a* also differs from assembly 22 in that assembly 22*a* includes removable valve assemblies 500 in which valves 148 are included and therefore also removable. More particularly, in this embodiment, fitting 164*a* includes a recess 504 configured to receive a portion of valve assembly 500 without threads or welding to permit fluid communication between fitting lumen 168 and the valve assembly. In this embodiment, first connector 180*a* includes a protrusion 508 configured to extend into recess 504 to connect valve 148 and fitting lumen 168. In some embodiments, such as the one shown, fitting 164*a* includes internal grooves 512 around recess 504 that are configured to receive sealing and/or lubricating components (e.g., O-rings, rigid washers, grease, and/or the like) to facilitate insertion of a protrusion 208 into the recess 216 and/or improve the seal between second connector 196 and third connector 212. In this embodiment, recess 508 has a longitudinal axis 516 that is substantially parallel to longitudinal axis 156 of the main tube. As such, the connection between first connector 180*a* and fitting 164*a* provides a slidable, removable connection similar to the one between second connector 196 and third connector 212 in assembly 22.

Figure 10:
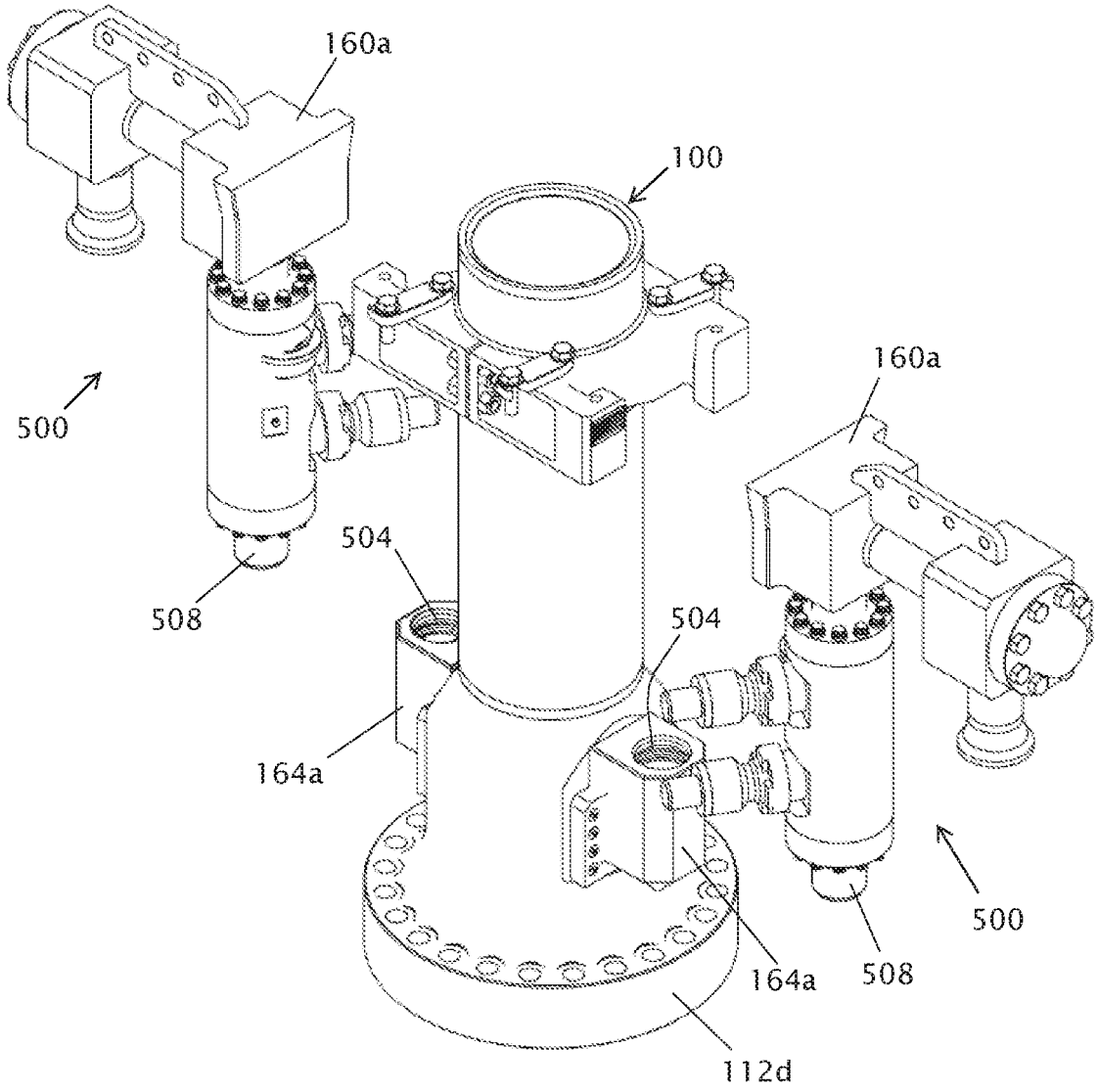
FIG. 10 depicts a partially disassembled, cutaway perspective view of the riser segment assembly of FIG. 7.
Figure 11:
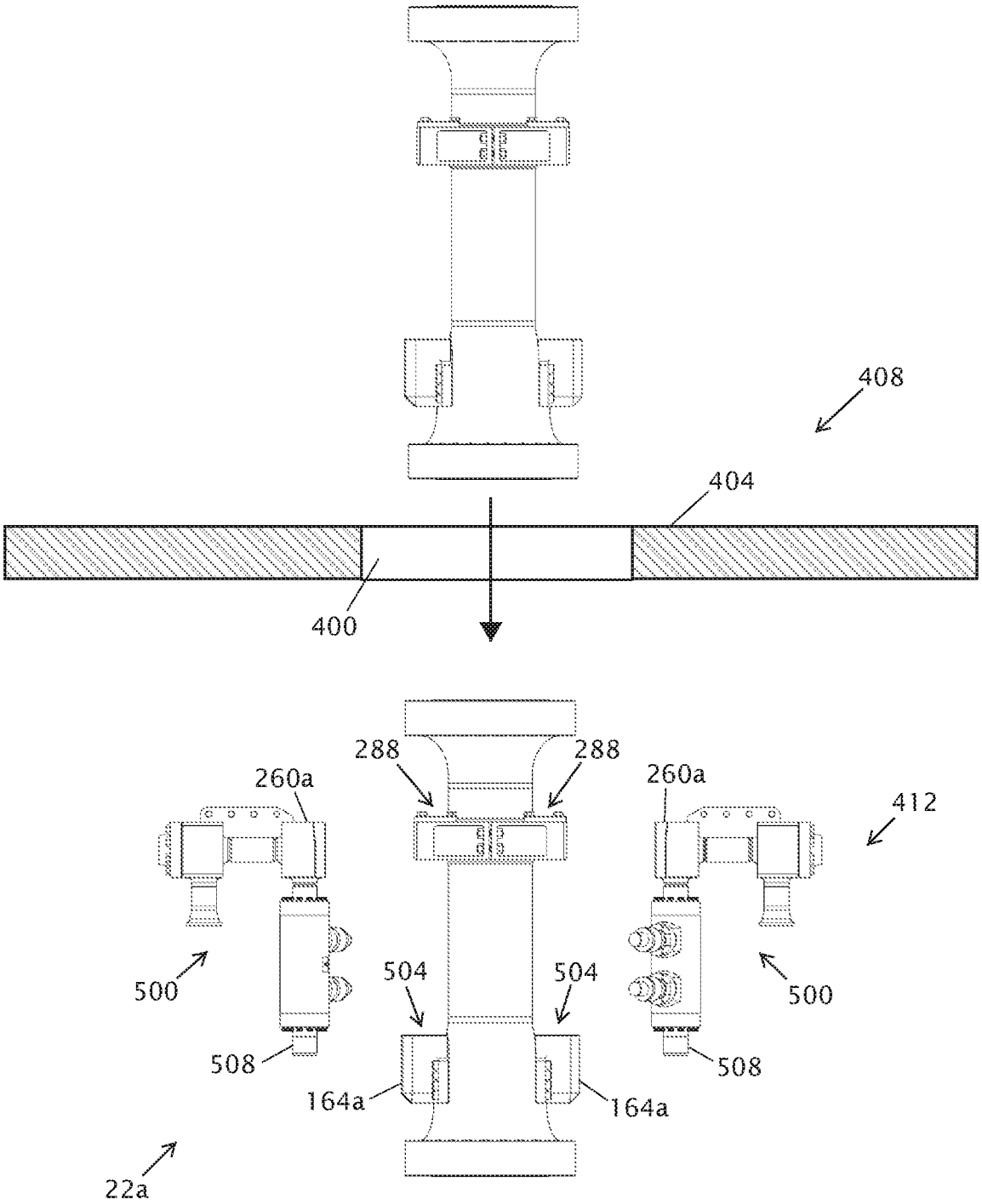
FIG. 11 depicts a side view of the riser segment assembly of FIG. 7 being lowered through a rotary and partially assembled below the rotary in accordance with some embodiments of the present methods.

In the embodiment shown, second connector 196*a* is welded to third connector 212*a*, and are collectively referred to as second connector 520 for purposes of describing certain features of assembly 22*a*. For example, in this embodiment, each valve assembly 500 includes first connector 180*a*, valve 148, and second connector 520. Assembly 22*a* is configured such that valve assemblies 500 are removable (as shown in FIG. 10) to permit the remainder of assembly 22*a* to be lowered through a rotary of a drilling rig as shown in FIG. 11, and the valve assemblies 500 connected below the rotary. More particularly, in this embodiment, fitting 264*a* is lowered into recess 288 of retainer 280 while protrusion 508 of first connector 180*a* is simultaneously inserted into recess 504 of fitting 164*a*, after which members 300 can be secured to prevent removal of fitting 260*a* from recess 288. In the embodiment shown, the maximum transverse dimension (defined between fittings 164*a*) of assembly 22*a* without valve assemblies 500 is less than 60.5 inches, and the maximum transverse dimension (defined by covers 248) is greater than 60.5 inches with the valve assemblies 500 connected to the remainder of assembly 22*a*.

The above specification and examples provide a complete description of the structure and use of illustrative embodiments. Although certain embodiments have been described above with a certain degree of particularity, or with reference to one or more individual embodiments, those skilled in the art could make numerous alterations to the disclosed embodiments without departing from the scope of this invention. As such, the various illustrative embodiments of the devices are not intended to be limited to the particular forms disclosed. Rather, they include all modifications and alternatives falling within the scope of the claims, and embodiments other than the one shown may include some or all of the features of the depicted embodiment. For example, components may be omitted or combined as a unitary structure, and/or connections may be substituted. Further, where appropriate, aspects of any of the examples described above may be combined with aspects of any of the other examples described to form further examples having comparable or different properties and addressing the same or different problems. Similarly, it will be understood that the benefits and advantages described above may relate to one embodiment or may relate to several embodiments.

The claims are not intended to include, and should not be interpreted to include, means-plus- or step-plus-function limitations, unless such a limitation is explicitly recited in a given claim using the phrase(s) "means for" or "step for," respectively.

The invention claimed is:

1. A riser segment assembly comprising:

a main tube defining a primary lumen and a collar defining a lateral opening in fluid communication with the primary lumen;

two flanges each coupled to a different end of the main tube, each flange comprising:

a mating face configured to mate with a flange of an adjacent riser segment; and a central flange lumen configured to be in fluid communication with the primary lumen of the main tube;

a valve coupled to the lateral opening, the valve having a longitudinal flow axis that is more parallel than perpendicular to a longitudinal axis of the main tube;

a retainer coupled to the main tube, the retainer comprising a body having a top, a bottom, and a periphery between the top and the bottom, the body defining a recess extending laterally through the periphery of the body; and a first connector configured to be coupled to the valve and to releasably engage the retainer without welding to secure the first connector in fixed relation to the main tube;

wherein the recess is configured to receive a portion of the first connector and thereby restrict lateral movement of the first connector and at least a portion of the valve relative to the main tube.

2. The assembly of claim 1, where the valve comprises a double ball valve.

3. The assembly of claim 1, further comprising:

a fitting coupled to the collar over the lateral opening and to the valve, the fitting defining a fitting lumen in fluid communication with the lateral opening.

4. The assembly of claim 3, where a portion of the fitting that is closer to the valve than to the collar has a longitudinal axis that is substantially parallel to the longitudinal axis of the main tube.

5. The assembly of claim 3, further comprising:

a second connector secured to the fitting and to a first end of the valve, a third connector secured to a second end of the valve, wherein at least one connection between the fitting, the first connector, the second connector, and the third connector comprises a recess configured to slidably receive a protrusion to provide a sealed connection.

6. The assembly of claim 5, where the first connector defines a lumen having an inlet through which fluid can enter the first connector in a first direction, and an outlet through which fluid can exit the first connector in a second direction that is different than the first direction.

7. The assembly of claim 6, where the first connector further defines a secondary lumen with a second exit sealed by a removable cover, the second exit configured such that if the cover is removed, fluid can exit the first connector in a third direction that is different than the first direction and the second direction.

8. The assembly of claim 1, where the retainer includes one or more movable members pivotally coupled to the body and movable between an open position in which the first connector is permitted to enter or exit the recess of the body, and a closed position in which the one or more movable members prevent the first connector from entering or exiting the recess of the body.

9. The assembly of claim 5, where the maximum transverse dimension of the assembly is greater than 60.5 inches if the first connector is coupled to the main tube, and is less than 60.5 inches if the first connector is not coupled to the main tube.

10. The assembly of claim 3, where the fitting and the collar are configured to form a substantially gapless connection comprising:

a female flange having an inward-facing conically tapered sealing surface;

a male flange having an outward-facing conically tapered sealing surface; and a seal ring having an outward-facing conically tapered surface complementary to the sealing surface of the female flange and an inward-facing conically tapered surface complementary to the sealing surface of the male flange;

where the seal ring is positioned between the male and female flanges with the conically tapered surfaces of the seal ring in contact with the complementary sealing surfaces of the male and female flanges and the male and female flanges are coupled together to form a connection between the primary lumen of the main tube and the fitting lumen of the fitting;

where one of the collar and the fitting defines the female flange, and the other of the collar and the fitting defines the male flange and where an interface between male flange and the female flange is substantially free of gaps.

11. The assembly of claim 1, where the collar defines a second lateral opening in fluid communication with the primary lumen of the main tube, the assembly further comprising:

a second valve coupled to the second lateral opening, the second valve having a longitudinal flow axis that is more parallel than perpendicular to the longitudinal axis of the main tube.

12. The assembly of claim 11, further comprising:

a second fitting coupled to the collar over the second lateral opening and to the second valve, the second fitting defining a fitting lumen in fluid communication with the second lateral opening.

13. The assembly of claim 8, wherein, in the closed position, a portion of at least one of the one or more movable members overlies the recess of the body.

14. The assembly of claim 1, wherein the first connector comprises a lateral protrusion.

15. The assembly of claim 14, wherein the recess of the body includes a lateral groove configured to receive the lateral protrusion of the first connector to restrict lateral movement of the first connector relative to main tube.

16. The assembly of claim 15, wherein the lateral protrusion of the first connector tapers from a larger top to a smaller bottom and the lateral groove of the recess tapers from a larger top to a smaller bottom to restrain downward vertical freedom of the first connector relative to the retainer.

17. The assembly of claim 1, where the recess includes:

a first portion extending longitudinally through at least a portion of the body; and a second portion extending laterally from the first portion through the periphery.

18. A method comprising:

lowering a riser segment assembly of claim 1 through a rotary of a drilling rig.

19. The method of claim 18, further comprising:

connecting, below the rotary, the first connector of claim 5 to the riser segment assembly without welding.

20. A riser segment assembly comprising:

a main tube defining a primary lumen and a collar defining a lateral opening in fluid communication with the primary lumen;

two flanges each coupled to a different end of the main tube, each flange comprising:

a mating face configured to mate with a flange of an adjacent riser segment; and a central flange lumen configured to be in fluid communication with the primary lumen of the main tube; and a fitting coupled to the collar over the lateral opening and configured to be removably coupled to a valve assembly, the fitting defining a fitting lumen in fluid communication with the lateral opening;

a retainer coupled to the main tube, the retainer comprising a body having a top, a bottom, and a periphery between the top and the bottom, the body having a recess that is:

longitudinally aligned with the fitting;

extends laterally through the periphery of the body; and configured to receive a portion of a first connector and thereby restrict lateral movement of the first connector and at least a portion of the valve assembly relative to the main tube.

21. The assembly of claim 20, where the fitting includes a recess configured to receive a portion of the valve assembly without threads or welding to permit fluid communication between the fitting lumen and the valve assembly.

22. The assembly of claim 21, where the recess of the fitting that is configured to receive the portion of the valve assembly has a longitudinal axis that is substantially parallel to a longitudinal axis of the main tube.

23. The assembly of claim 22, further comprising:

the valve assembly comprising a second connector configured to be inserted into the recess of the fitting and a valve disposed between the first connector and the second connector.

24. The assembly of claim 23, where the valve comprises a double-ball valve.

25. The assembly of claim 23, where the first connector defines a lumen having an inlet through which fluid can enter the first connector in a first direction, and an outlet through which fluid can exit the first connector in a second direction that is different than the first direction.

26. The assembly of claim 25, where the second direction is substantially opposite the first direction.

27. The assembly of claim 25, where the first connector further comprises a secondary lumen with a second exit sealed by a removable cover, the second exit configured such that if the cover is removed, fluid can exit the first connector in a third direction that is different than the first direction and the second direction.

28. The assembly of claim 20, where the retainer includes one or more movable members pivotally coupled to the body and movable between an open position in which the first connector is permitted to enter or exit the recess of the body, and a closed position in which the one or more movable members prevent the first connector from entering or exiting the recess of the body.

29. The assembly of claim 23, where the maximum transverse dimension of the assembly is greater than 60.5 inches if the valve assembly is coupled to the fitting, and is less than 60.5 inches if the valve assembly is not coupled to the fitting.

30. The assembly of claim 20, where the fitting and the collar are configured to form a substantially gapless connection comprising:

a female flange having an inward-facing conically tapered sealing surface;

a male flange having an outward-facing conically tapered sealing surface; and a seal ring having an outward-facing conically tapered surface complementary to the sealing surface of the female flange and an inward-facing conically tapered surface complementary to the sealing surface of the male flange;

where the seal ring is positioned between the male and female flanges with the conically tapered surfaces of the seal ring in contact with the complementary sealing surfaces of the male and female flanges and the male and female flanges are coupled together to form a connection between the primary lumen of the main tube and the fitting lumen of the fitting;

where one of the collar and the fitting defines the female flange, and the other of the collar and the fitting defines the male flange and where an interface between male flange and the female flange is substantially free of gaps.

31. The assembly of claim 20, where the collar defines a second lateral opening in fluid communication with the primary lumen of the main tube, the assembly further comprising:

a second fitting coupled to the collar over the second lateral opening and configured to be removably coupled to a valve assembly, the second fitting defining a fitting lumen in fluid communication with the lateral opening.

32. The assembly of claim 31, where the second fitting is substantially similar to the fitting.

33. The assembly of claim 28, wherein, in the closed position, a portion of at least one of the one or more movable members overlies the recess of the body.

34. The assembly of claim 20, wherein the first connector comprises a lateral protrusion.

35. The assembly of claim 34, wherein the recess of the body includes a lateral groove configured to receive the lateral protrusion of the first connector to restrict lateral movement of the first connector relative to main tube.

36. The assembly of claim 35, wherein the lateral protrusion of the first connector tapers from a larger top to a smaller bottom and the lateral groove of the recess tapers from a larger top to a smaller bottom to restrain downward vertical freedom of the first connector relative to the retainer.

37. The assembly of claim 20, wherein the first connector includes a recess configured to receive a second portion of the valve assembly without threads or welding to permit fluid communication between the first connector and the valve assembly.

38. A method comprising:

lowering a riser segment assembly of claim 20 through a rotary of a drilling rig; and connecting, below the rotary, a valve assembly of claim 26 to the riser segment assembly without welding.

* * * * *